US005981859A

United States Patent [19]

Suzuki

[11] Patent Number: 5,981,859

[45] Date of Patent: Nov. 9, 1999

[54] MULTI TONE GENERATOR

[75] Inventor: Hideo Suzuki, Hamamatsu, Japan

[73] Assignee: Yamaha Corporation, Hamamatsu, Japan

[21] Appl. No.: 09/158,601

[22] Filed: Sep. 23, 1998

[30] Foreign Application Priority Data

Sep. 24, 1997 [JP] Japan ..... 9-259003

[51] Int. Cl.[6] ..... G10H 7/00

[52] U.S. Cl. ..... 84/601; 84/622; 84/625; 84/659; 84/660

[58] Field of Search ..... 84/601, 602, 604–607, 84/622–625, 627, 659–660, 626

[56] References Cited

U.S. PATENT DOCUMENTS 4,967,635 11/1990 Nagai et al. .
4,984,276 1/1991 Smith .
5,191,161 3/1993 Oya .
5,319,151 6/1994 Shiba et al. .
5,354,948 10/1994 Toda ..... 84/624
5,596,159 1/1997 O'Connell .

FOREIGN PATENT DOCUMENTS 62-47316 10/1987 Japan .
63-40199 2/1988 Japan .

OTHER PUBLICATIONS

Hal Chamberlin, "Musical Applications of Microprocessors", 2nd Ed., Hayden Books, 1987, pp. 639–774.

*Primary Examiner*—William M. Shoop, Jr.
*Assistant Examiner*—Marlon T. Fletcher
*Attorney, Agent, or Firm*—Graham & James LLP

[57] ABSTRACT

A multi tone generator having a module for instructing a start of generating a musical tone signal, a module for designating a tone generator type for generating the musical tone signal, from a plurality of tone generator types; a module for performing a common process shared by the plurality of tone generator types, when the start of generating the musical tone signal is instructed; and a module for performing a process specific to the designated tone generator type, by using results of the common process.

44 Claims, 14 Drawing Sheets

KEY_ON
KC
TOUCH
PAR_NO
TG_TYPE
KEY_OFF
FLG1
CPARBUF 1
TYPPARBUF 1
75
WAVEBUF
WAVE1
WAVEa
ACCM
ch 1
ch j
76
PLAY INFO
77

53
OS FIELD
TONE GENE-RATOR DRIVER
DATA BUFFER FIELD
APPLICATION FIELD
(AUTOMATIC PERFORMANCE PROGRAM)
71
72
73
74
54
SETUP PROGRAM

MULTI TONE GENERATOR

This application is based on Japanese patent application No. 9-259003 filed on Sep. 24, 1997, the entire contents of which are incorporated herein by reference.

BACKGROUND OF THE INVENTION a) Field of the Invention

The present invention relates to musical tone signal generating techniques, and more particularly to techniques of generating musical tone signals by using a plurality of tone generators (sound sources) of different types.

b) Description of the Related Art

Various tone generators of different types are known, including pulse code modulation (PCM) tone generators, frequency modulation (FM) tone generators, and physical model tone generators. Each tone generator generates musical tone waveforms in a different manner to achieve particular tone colors. For example, the physical model tone generator is suitable for generating tone colors of stringed instruments and wind instruments.

A player can play both melody and accompaniment parts by using an electronic musical instrument. In general, tone colors of melody and accompaniment parts are often changed during performance. For example, tone colors of a stringed instrument are assigned to melody parts, whereas tone colors of a keyboard instrument are assigned to accompaniment parts. In an ideal, typical example, musical tone signals for melody parts are generated by using a physical model tone generator rich in musical expression, and musical tone signals for accompaniment parts are generated by using a PCM or FM tone generator capable of generating a number of musical tones relatively inexpensively.

As above, each tone generator generates some tone colors excellently but some tone colors poorly. If a tone generator superior to generating musical tones of a particular tone color is selectively used, it is possible to make musical performance with fine melody sounds of a musical piece or with substantial accompaniment sounds. In order to realize such performance with conventional techniques, a plurality of tone generators of different types are interconnected via musical instrument digital interface (MIDI) to configure an integrated tone generator system mixed with a plurality of tone generators. However, in this case, the physical scale of the system becomes bulky and the system becomes expensive.

Each tone generator has a common part more or less although its configuration changes from one type to another. If a plurality of tone generators are used, the same common part is used in duplicate by each tone generator so that the system becomes inefficient and expensive.

SUMMARY OF THE INVENTION

It is an object of the present invention to provide a musical tone signal generating method for a multi tone generator capable of efficiently generating various kinds of musical tone signals, to a multi tone generator, and to a storage medium which stores programs realizing such a method.

According to one aspect of the present invention, there is provided a musical tone signal generating method for a multi tone generator, comprising the steps of: (a) instructing a start of generating a musical tone signal; (b) designating a tone generator type for generating the musical tone signal, from a plurality of tone generator types; (c) performing a common process shared by the plurality of tone generator types, when the start of generating the musical tone signal is instructed; and (d) performing a process specific to the designated tone generator type, by using results of the common process.

As the tone generator type is designated and a start of generating a musical tone signal is instructed, the musical tone signal appropriate for the designated tone generator type can be generated. After the common process shared by a plurality of tone generator types is executed, a process specific to the designated tone generator type is executed so that musical tone signals of the plurality of tone generator types can be generated efficiently.

DETAILED DESCRIPTION OF THE PREFERRED EMBODIMENTS

Figure 1:
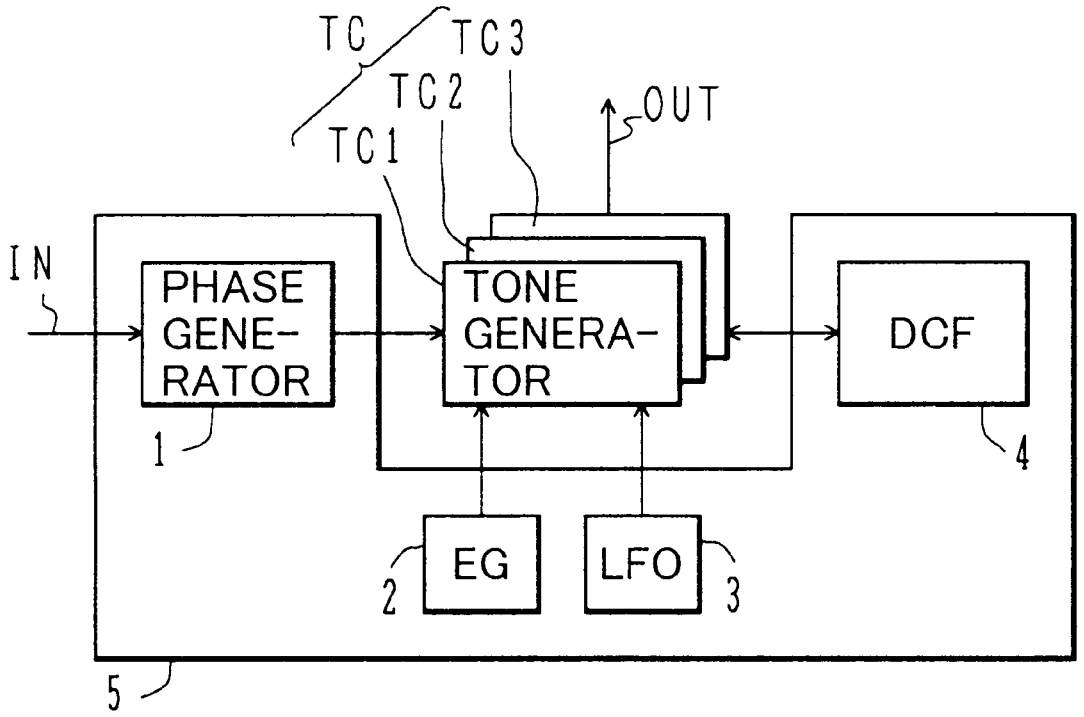
FIG. 1 is a conceptual block diagram showing a multi tone generator according to an embodiment of the invention.

FIG. 1 is a conceptual block diagram showing a multi tone generator according to an embodiment of the invention.

A multi tone generator TC has, for example, three tone generators TC1, TC2, and TC3 of different types. The tone generators TC1 to TC3 may be a combination of a PCM tone generator, an FM tone generator, and a physical model tone generator. A formant tone generator may also be used.

A common control unit 5 is shared by a plurality of tone generators TC1 to TC3, each having a specific controller necessary for its own control without having by itself the common control unit 5. Namely, the common control unit 5 is used for the common control of the tone generators TC1 to TC3, and the specific controllers are used for the specific control of each tone generator.

An input signal IN is supplied to the multi tone generator, the input signal being a key-on/off, a key code, tone color information, touch information and the like.

The common control unit 5 has, for example, a phase generator 1, an envelope generator (EG) 2, a low frequency oscillator (LFO) 3, and a digital control filter (DCF) 4.

The phase generator 1 generates phase data on the basis of a key code contained in the input signal IN, and supplies the phase data to the multi tone generator TC. The phase data can be used by both the PCM and FM tone generators. The details of the phase data will be later given.

The envelope generator 2 generates an envelope of a musical tone wave form corresponding to, for example, a volume of the musical tone, and supplies the envelope to the multi tone generator TC. The envelope can be used by all types of tone generators. The envelope may be used as other parameters in addition to the volume.

The low frequency oscillator 3 generates a low frequency signal and supplies it to the multi tone generator TC. The low frequency signal can be used by all types of tone generators. For example, it can be used as a parameter for controlling the effects to be given to a musical tone.

The digital control filter 4 filters a musical tone signal generated by the multi tone generator TC to give various effects to each musical tone.

In accordance with tone color information contained in the input signal IN, a predetermined one of the tone generators TC1 to TC3 is selected and operated. For example, if a tone color of a stringed or wind instrument is designated, only the physical model tone generator TC3 is operated and the other tone generators TC1 and TC2 are not operated.

The multi tone generator TC outputs a musical tone signal OUT which may be a signal generated by one of the tone generators TC1 to TC3 or a synthesized signal of musical tone signals generated by the tone generators TC1 to TC3. A musical tone signal once generated by the multi tone generator TC may be returned to the common control unit 5 to be passed through the digital control filter 4 or the like, and thereafter it is input to the multi tone generator TC and output as a musical tone signal OUT.

Figure 2:
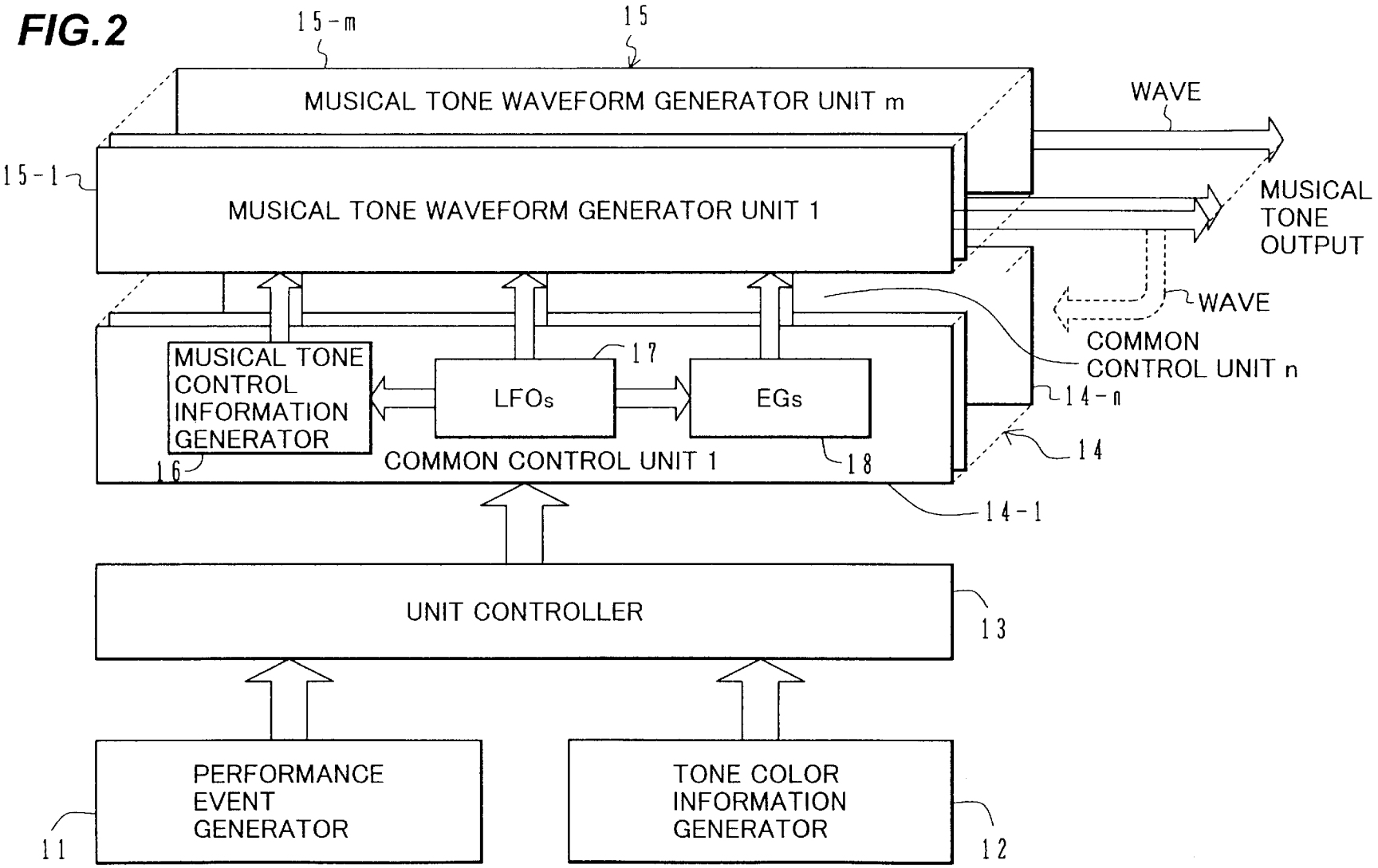
FIG. 2 is a block diagram showing the structure of the multi tone generator of the embodiment.

FIG. 2 is a block diagram showing a more specific structure of the multi tone generator of the embodiment.

A performance event generator 11 generates and/or outputs a performance event, the generator being, for example, a performance operator (keyboard or the like) and/or an automatic performance apparatus (sequencer or the like). A performance event is, for example, a key-on/off event which is supplied to a unit controller 13.

A tone color information generator 12 generates tone color information (tone color parameter), and has a tone color designating operator and a tone color data memory. The tone color information is generated in accordance with a tone color designated by a player with the tone color designating operator, and supplied to the unit controller 13.

The unit controller 13 generates a control parameter in accordance with a performance event and tone color information, and supplies it to one of a plurality of common control units 14.

The common control unit 14 is constituted of units 14-1 to 14-n of n types. The type of a tone generator is determined in accordance with a tone color (musical instrument) of a musical tone to be generated, and in accordance with the tone generator type, one or a plurality of common control units 14-1 to 14-n are determined.

For example, the first common control unit 14-1 has a pitch control information generator 16, a low frequency oscillator (LFO) 17, and an envelope generator (EG) 18. The other common control units 14-2 to 14-n may have the same structure as that of the common control unit 14-1 or a different structure.

For example, the first common control unit 14-1 generates principal tone colors for a PCM tone generator. If a complicated tone color for an FM tone generator, a physical tone generator, or the like is to be generated, a plurality of common control units 14 are used. The details thereof will be later given.

The common control unit 14 generates a musical tone parameter and supplies it to a musical tone waveform generator unit 15, upon reception of a control parameter from the unit controller 13 and/or a musical tone signal WAVE fed back from the musical tone waveform generator unit 15.

The musical tone waveform generator unit 15 is constituted of m units 15-1 to 15-m for realizing m tone generators. The type of a tone generator is determined in accordance with a tone color (musical instrument), and in accordance with the tone generator type, one of the musical tone waveform generator units 15-1 to 15-m is determined. Although one tone color is basically generated by one tone generator, one tone color may be generated by a combination of a plurality of tone generators. Alternatively, m musical tone waveform generator units for realizing m tone generators may be b units for each of a tone generators where m=a×b, or d1, d2, . . . , dc units for each of c tone generators where m=d1+d2 +, . . . , +dc.

The musical tone waveform generator unit 15 has its specific musical tone waveform generator to output a musical tone signal WAVE.

The multi tone generator of this embodiment can selectively use tone generators of a plurality of different types. Next, examples of a tone generator will be described, the structures of which are shown in FIG. 3 for a PCM tone generator, in FIG. 4 for an FM tone generator, and in FIG. 5 for a physical model tone generator.

Figure 3:
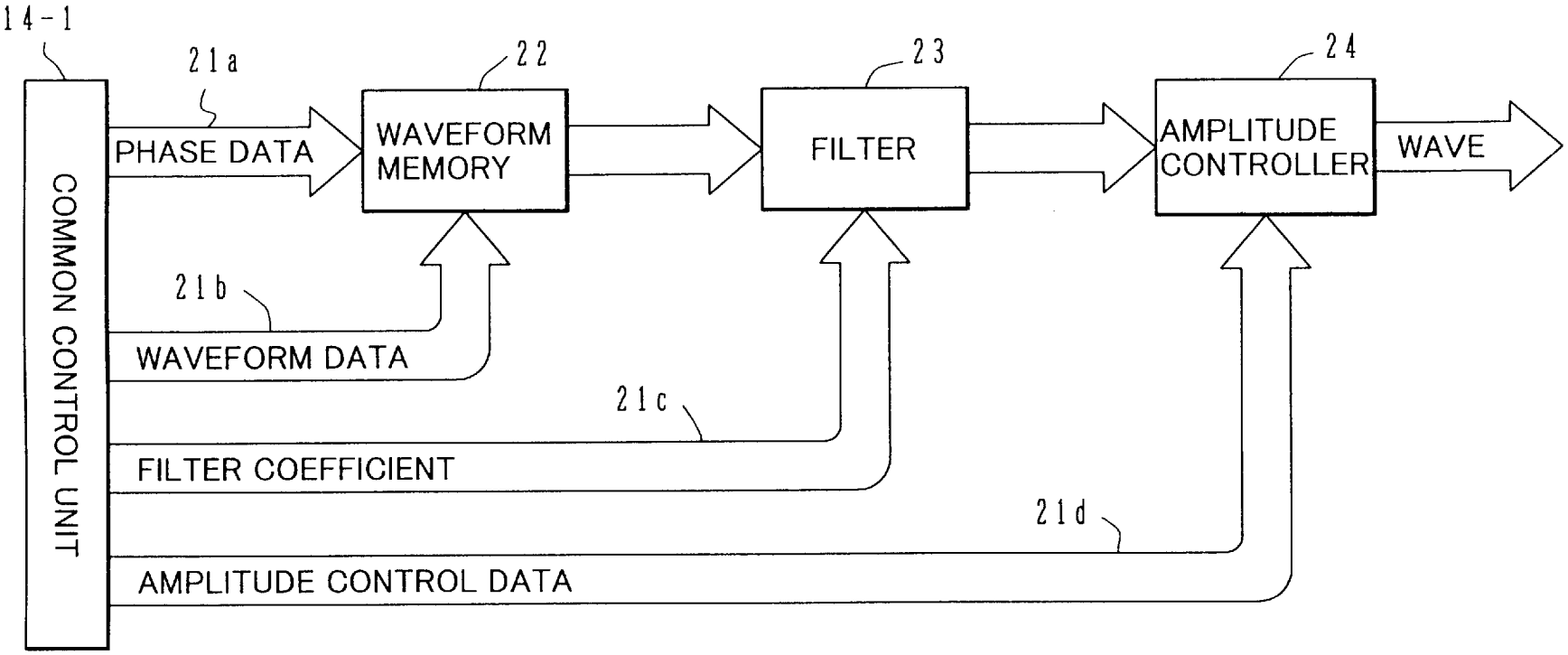
FIG. 3 is a block diagram showing an example of the structure of a PCM tone generator.

FIG. 3 is a block diagram showing an example of the structure of a PCM tone generator. Basically, the PCM tone generator reads a musical tone signal waveform stored in a waveform memory and generates a musical tone signal.

The common control unit 14-1 has the structure same as that shown in FIG. 2, and outputs phase data 21*a*, waveform data 21*b*, filter coefficients 21*c*, and an amplitude control data 21*d*.

For example, the phase data 21*a* is generated by the pitch control information generator 16 (FIG. 2) of the common control unit 14-1 in accordance with a key code. The filter coefficient 21*c* and amplitude control data 21*d* are generated, for example, by the envelope generator 18 (FIG. 2) of the common control unit 14-1.

The waveform memory 22 stores a musical tone waveform in a digital form. The waveform data 21*b* identifies the type of a waveform in the waveform memory 22. The phase data 21*a* identifies a read phase (address) in the waveform memory 22 to determine a pitch of the musical tone. The waveform memory 22 supplies a musical tone waveform matching the waveform data 21*b* and phase data 21*a* to the filter 23.

The filter 23 filters the musical tone waveform supplied from the waveform memory 22, in accordance with the filter coefficients 21*c*, and outputs the filtered musical tone waveform to the amplitude controller 24. For example, the filter 23 is a band-pass filter for passing a predetermined frequency band.

The amplitude controller 24 controls the amplitude of a musical tone waveform in accordance with the amplitude control data 21*d*, and outputs the musical tone signal WAVE. For example, the amplitude controller 24 is a multiplier for multiplying the musical tone waveform by the amplitude control data 21*d* in order to control the amplitude of the musical tone.

The filter 23 and amplitude controller 24 have often standard structures so that they may be structured in the common control unit 14-1.

For the general background of PCM tone generator, for example, refer to U.S. Pat. No. 4,967,635 (JP-B-SHOU 62-11358) which is herein incorporated by reference.

Figure 4:
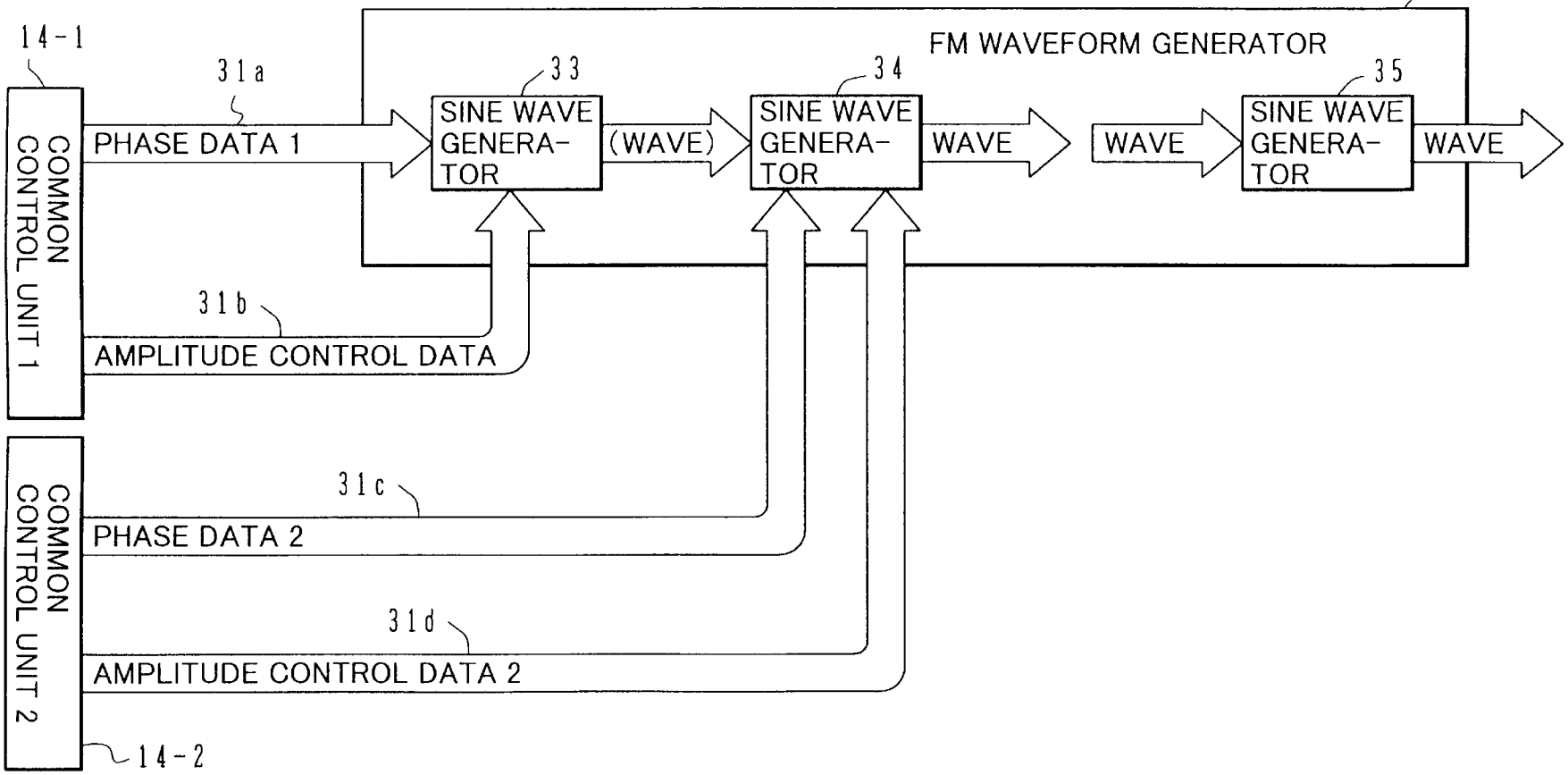
FIG. 4 is a block diagram showing an example of the structure of an FM tone generator.

FIG. 4 is a block diagram showing an example of the structure of an FM tone generator. The FM tone generator does not read a stored waveform but synthesizes a musical tone waveform signal.

The FM tone generator uses two common control units 14-1 and 14-2, for example. The common control unit 14-1 generates first phase data 31*a* and first amplitude control data 31*b* and supplies them to a sine wave generator 33. The common control unit 14-2 generates second phase data 31*c* and second amplitude control data 31*d* and supplies them to a sine wave generator 34.

Similar to the PCM tone generator, for example, the phase data 31*a* and 31*c* are generated by the pitch control information generator 16 (FIG. 2), and the amplitude control data 31*b* and 31*d* are generated by the envelope generator 18 (FIG. 2).

The FM tone generator 32 (musical tone waveform generator unit 15 shown in FIG. 2) determines a tone color by a combination (algorithm) of one or two operators. The sine wave generator 33 corresponds to the first operator, and the sine wave generator 34 corresponds to the second operator.

The sine wave generator 33 generates a sine wave in accordance with the phase data 31*a* and amplitude control data 31*b* and supplies it to the sine wave generator 34. The sine wave generator 34 modulates the supplied sine wave in accordance with the phase data 31*c* and amplitude control data 31*d,* and outputs a musical tone signal WAVE.

This musical tone signal WAVE may be modulated further by a sine wave generator 35. In this case, three operators are used. The number of operators may be two, three or more. Each operator is basically assigned one common control unit 14.

The FM tone generator 32 may perform calculations by using a plurality of channels corresponding to a plurality of operators, or a plurality of operators may be combined to a single structure.

For the general background of FM tone generator, for example, refer to U.S. Pat. No. 5,191,161 (JP-B-SHOU 57-43920) which is herein incorporated by reference.

Figure 5:
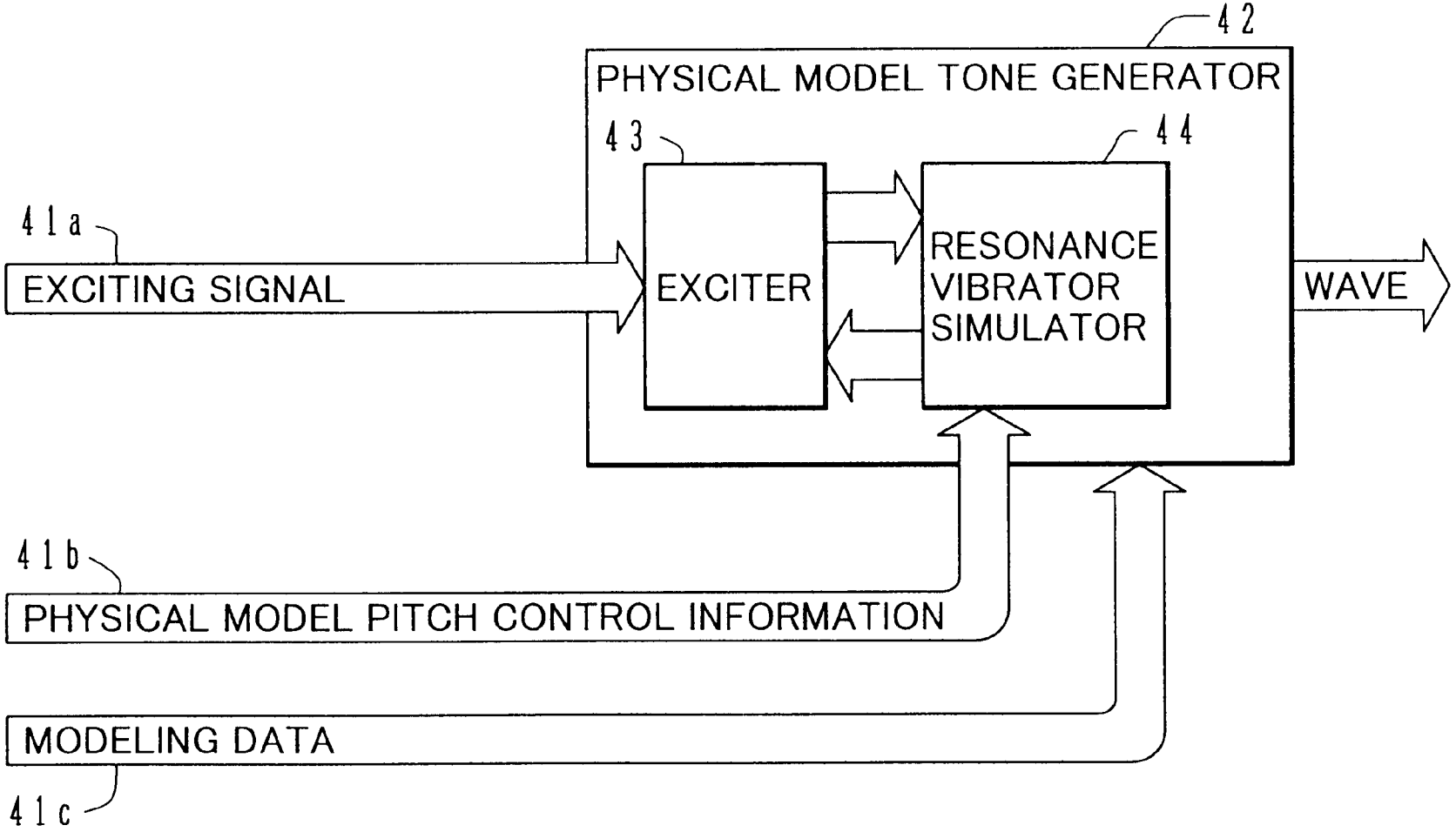
FIG. 5 is a block diagram showing an example of the structure of a physical model tone generator.

FIG. 5 is a block diagram showing an example of the structure of a physical model tone generator. The physical model tone generator generates a musical tone signal by simulating a physical structure of a musical instrument by using electronic circuits. The physical model tone generator is particularly suitable when a tone color is to be expressed finely and vividly.

A physical model tone generator 42 (musical tone waveform generator unit 15 in FIG. 2) has an exciter 43 and a resonance vibrator simulator 44. Modeling data 41*c* is supplied to the physical model tone generator 42. The modeling data 41*c* determines the structure and characteristics of the physical model tone generator 42, and identifies a modeling subject such as a stringed or wind instrument.

An exciting signal 41*a* is supplied to the exciter 43. The exciting signal 41*a* is a signal representative of a blowing pressure (breath pressure) or a bow speed, for example. This signal may be generated by the envelope generator of the common control unit or by a performance operator. The exciter 43 starts exciting by using the exciting signal 41*a* as its trigger.

The resonance vibrator simulator 44 is supplied with physical model pitch control information 41*b* which may be a tube length or a string length, and determines a pitch. The pitch control information 41*b* may be generated by adding a time varying signal from the low frequency oscillator or envelope generator of the common control unit, to data entered with a performance operator.

The simulator 44 has a loop circuit to which the exciting signal is supplied from the exciter 43. The exciting signal circulates the loop circuit to simulate resonance of the vibrator. The simulator 44 also constitutes a loop with the exciter 43. The physical model tone generator 42 outputs a musical tone signal WAVE. The number of common control units varies with the modeling scale and the control amount.

For the general background of physical model tone generator, for example, refer to U.S. Pat. No. 4,984,276 (JP-A-SHOU 63-40199) which is herein incorporated by reference. A wind instrument model is shown in FIGS. 16 and 17 of this gazette and a stringed instrument (violin) is shown in FIG. 18.

Figure 6:
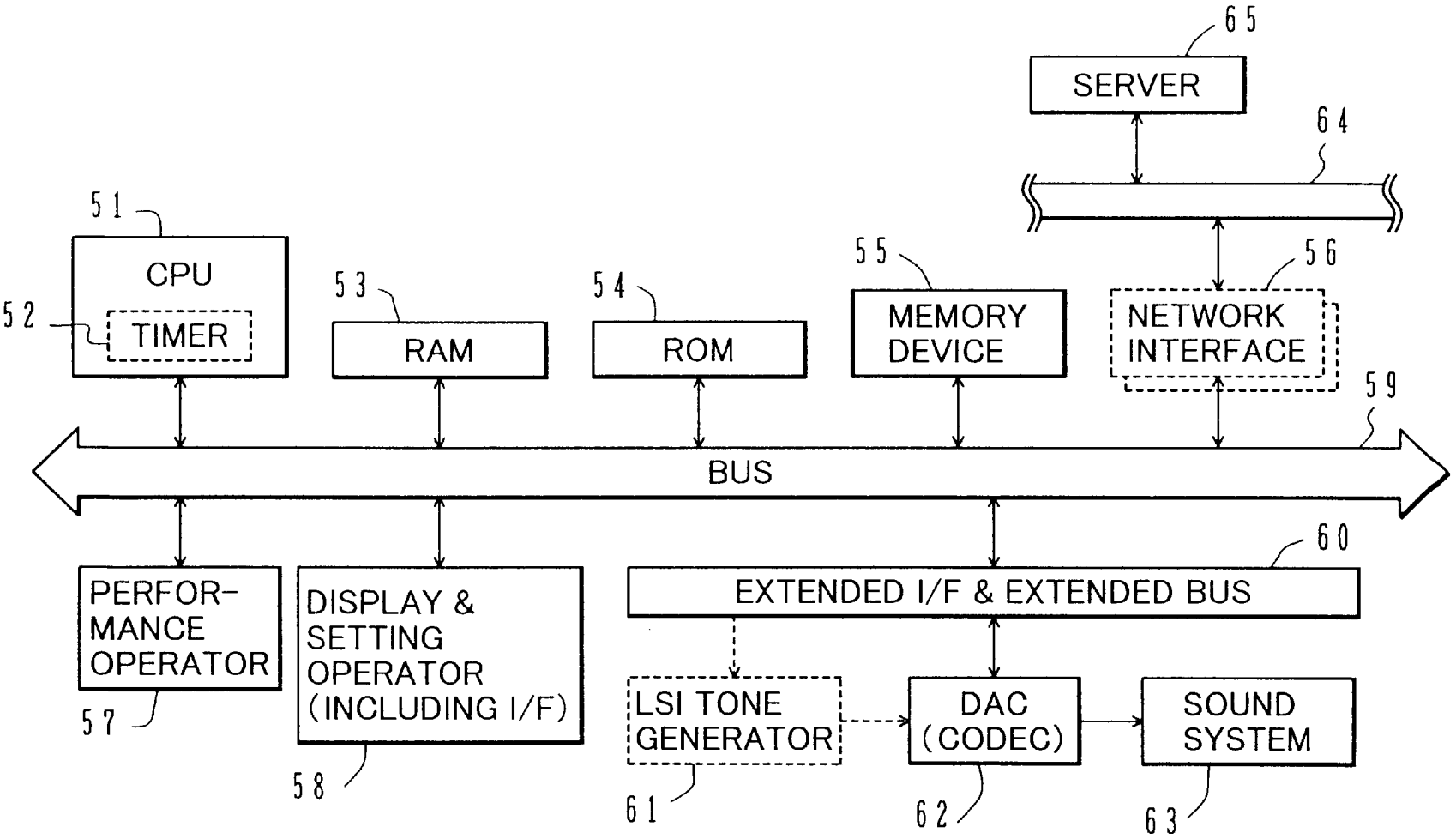
FIG. 6 is a diagram showing the hardware structure of the multi tone generator.

FIG. 6 shows the structure of a multi tone generator realized by a software tone generator. The software tone generator realizes the same function as a hardware tone generator by using computer software.

Connected to a bus 59 are a CPU 51, a RAM 53, a ROM 54, a memory device 55, a network interface 56, a performance operator 57, a panel 58 (display and setting operator), and an extended interface/extended bus 60.

The memory device 55 may be a hard disk drive, a floppy disk drive, a compact disc—read only memory (CD-ROM) drive, a magneto-optical disk drive or the like. The memory device 55 stores tone generator driver and various parameters necessary for realizing a multi tone generator, as well as automatic performance computer programs and data.

The tone generator drivers, automatic performance computer programs and the like are copied from the memory device 55 to RAM 53 in response to a predetermined instruction. The memory map of RAM 53 will be described later with reference to FIGS. 7A, 7B, and 8.

The panel 58 has a display and a setting operator with respective interfaces. The setting operator is used for setting a tone color, effects, and the like. The display is used for displaying information and the like entered by the setting operator.

The performance operator 57 is a keyboard, a press controller, or the like. A player can reproduce a musical tone having a desired pitch by manipulating the performance operator.

Figures 7A, 7B:
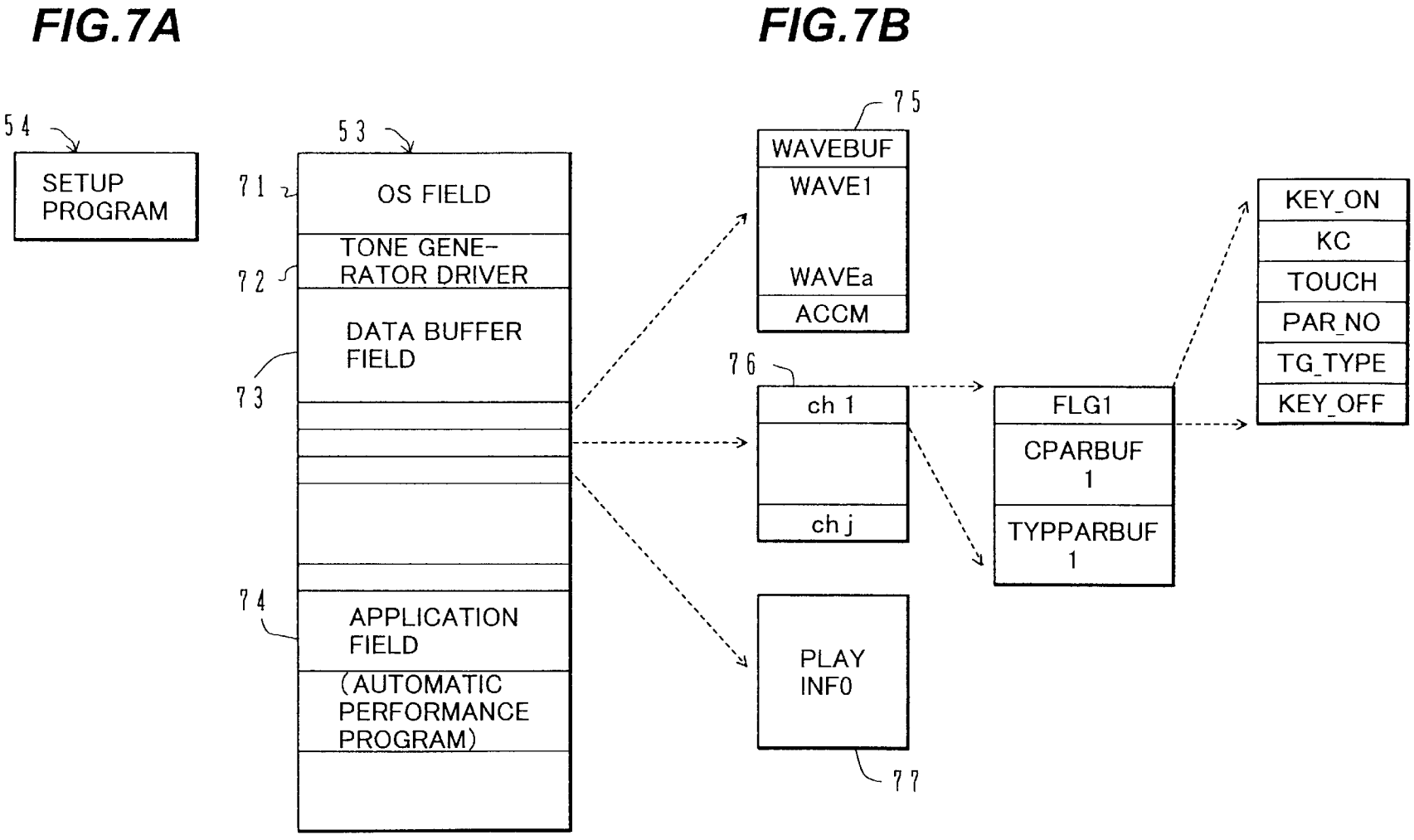
FIG. 7A is a memory map of a ROM.
FIG. 7B is a memory map of a RAM.

As shown in FIG. 7A, ROM 54 stores therein computer setup programs. When a power of the multi tone generator is turned on, an operating system (OS), tone generator drivers and the like are copied from the memory device 55 to RAM 53 in accordance with the setup programs. Thereafter, the multi tone generator operates in accordance with the operating system.

As the tone generator driver is instructed to be set up, CPU 51 prepares a tone generator in accordance with the tone generator driver stored in RAM 53. A musical tone signal is generated by an operation of a player or through automatic performance. Namely, as a player manipulates the performance operator 57, a musical tone signal is generated in accordance with the manipulation of the performance operator, whereas if an automatic performance is designated, an automatic performance computer program starts and generates musical tone signals in accordance with automatic performance data.

CPU 51 includes a timer 52 which generates time information. In accordance with this time information, CPU 51 executes a sound reproduction process and the like at proper timings.

CPU 51 supplies a musical tone signal to a D/A converter (DAC) 62 via the bus 59 and extended interface/extended bus 60. The D/A converter 62 converts the received digital musical tone signal into an analog signal which is supplied to a sound system 63. The sound system 63 has an amplifier and a speaker to amplify the analog musical tone signal and reproduce sounds.

The D/A converter 62 may be a coder/decoder (CODEC) circuit which has a D/A converter and an A/D converter with a mixing function.

Instead of a tone generator driver, a tone generator LSI may be used. In this case, an LSI tone generator 61 is connected to the extended interface/extended bus 60. CPU 51 supplies information of the setting operator or automatic performance data to the LSI tone generator 61 having the same function as a tone generator driver and outputting a musical tone signal to the D/A converter 62.

The network interface 56 may be a modem, an Ethernet interface, a MIDI interface, or an RS-232C interface, which enables connection to one of various networks.

If tone generator drivers, various parameters, and the like are stored in the memory device 55 and copied to RAM 53, addition, version-up and the like of a tone generator driver and the like become easy. The CD-ROM drive reads computer programs and various data stored in a CD-ROM. The read computer programs and various data are stored in a hard disk. Installation, version-up and the like of a computer program become easy.

The network interface 56 is connected to a communications network 64 such as a local area network (LAN), the Internet, and a telephone line, and via the communications network 64 to a server computer 65. If a tone generator driver and the like are not stored in the memory device 55, these tone generator driver and the like can be downloaded from the server computer 65. In this case, the multi tone generator as a client transmits a command for downloading the tone generator drive and the like to the server computer 65 via the network interface 56 and communications network 64. Upon reception of this command, the server computer 65 supplies the requested tone generator driver and the like to the multi tone generator via the communications network 64. The multi tone generator receives the tone generator driver and the like via the network interface 56 and stores them in the memory device 55.

This embodiment may be reduced into practice by a commercially available personal computer installed with tone generator drivers and the like realizing the functions of the embodiment. The tone generator drivers and the like may be supplied to a user in the form of a storage medium such as a CD-ROM and a floppy disk which the personal computer can read. If the personal computer is connected to the communications network such as the Internet, a LAN and a telephone line, computer programs and various data may be supplied to the personal computer via the communications network.

The multi tone generator may be applied, in addition to a personal computer, to an electronic musical instrument, a game machine, a karaoke machine, or a television.

FIG. 7B is a memory map of RAM 53.

RAM 53 has a field 71 for storing an operating system (OS), a field 72 for storing tone generator drivers, a field 73 for forming data buffers, and a field 74 for storing application programs (e.g., automatic performance computer program).

The data buffer field 73 has a waveform data buffer 75, a channel buffer 76, and a performance event buffer 77.

The waveform data buffer 75 has a buffer WAVEBUF for storing waveform calculation results, waveform output buffers WAVE1 to WAVEa for each channel, and a buffer ACCM for storing an accumulation of waveform outputs of all channels.

The performance event buffer 77 stores performance events sequentially generated in accordance with an automatic performance computer program. The tone generator driver generates a musical tone signal for each performance event.

The channel buffer 76 has buffers ch1 to chj for j channels. Each channel buffer has the same structure. For example, the first channel buffer ch1 has a buffer FLG1 for storing sound reproduction information, a buffer CPARBUF1 for storing common control parameters, and a buffer TYPPARBUF1 for storing control parameters specific to each tone generator.

The buffer FLG1 has a flag KEY_ON indicating that a sound reproduction start was designated by a key-on event, a register KC indicating a key code (pitch), a register TOUCH indicating touch information (initial touch and/or after touch) when a key is turned on, a register PAR_NO indicating a tone color, a register TG_TYPE indicating a tone generator type, and a flag KEY_OFF indicating that a sound reproduction stop was designated by a key-off event.

As the tone color number PAR_NO is determined, the tone generator type TG_TYPE is determined. The tone generator type TG_TYPE is determined when sounds are to be reproduced. For example, if a checked load state is heavy, the tone generator type TG_TYPE may be set so that a tone generator type having a light load is used.

Figure 8:
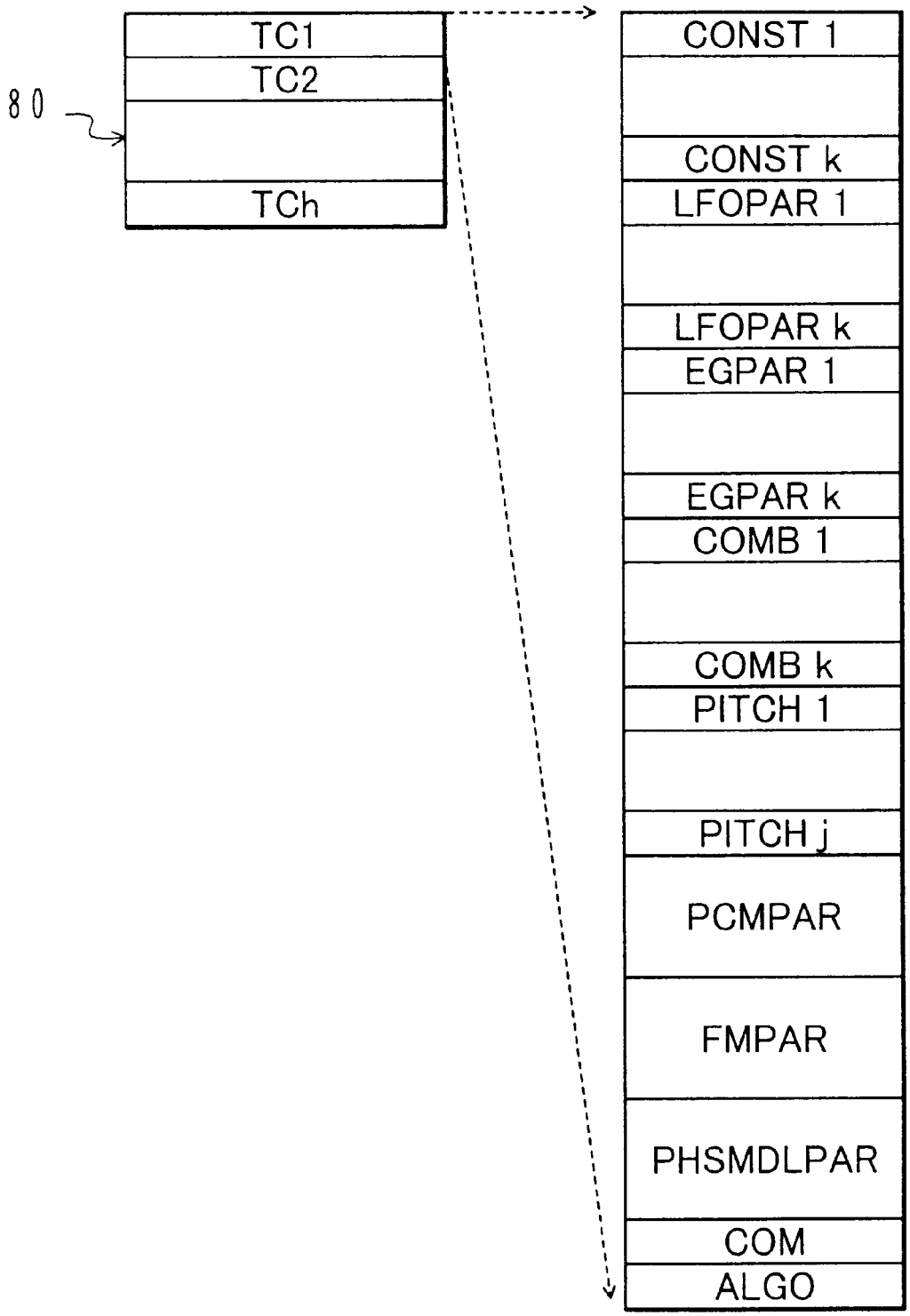
FIG. 8 is a diagram showing the structure of a tone color parameter set.

FIG. 8 shows the tone color parameter set 80 to be stored in RAM 53. The tone color parameter set 80 is loaded from the memory device 55 (FIG. 6) into RAM 53.

The tone color parameter set 80 has h tone color parameters TC1 to TCh corresponding to h tone colors. Each tone color parameter has the same structure.

For example, the first tone color parameter TC1 has k constant parameters CONST1 to CONSTk, k low frequency oscillator parameters LFOPAR1 to LFOPARk, k envelope generator parameters EGPAR1 to EGPARk, k combining operators COMB1 to COMBk (a combining operator for a plurality of parameters, e.g., multiplication operation), and j pitch parameters PITCH1 to PITCHj.

The first tone color parameter TC1 also has a parameter PCMPAR specific to a PCM tone color generator, a parameter FMPAR specific to an FM tone generator, and/or a parameter PHSMDLPAR specific to a physical model tone generator. It is sufficient if there is at least one of these parameters specific to tone generators.

The first tone color parameter TC1 also has a common control unit number COM and a musical tone signal generation calculation amount ALGO. For example, the common control unit number COM for the standard tone color of a PCM tone generator is "1", and the calculation amount ALGO is calculated as "1" per one common control unit for generating a musical tone signal.

The tone generator type TG_TYPE may be included in the first tone color parameter TC1.

Figure 9:
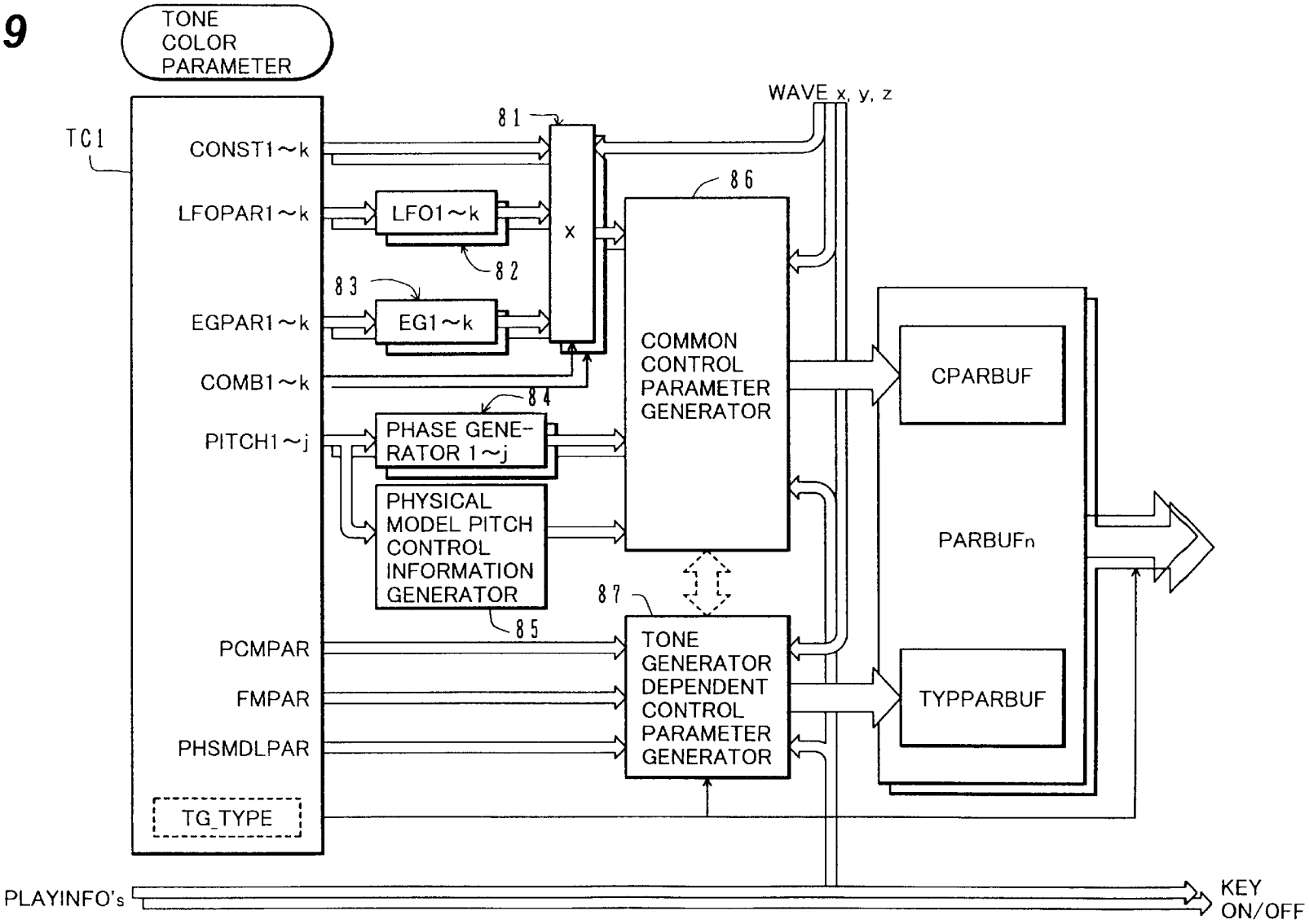
FIG. 9 is a block diagram illustrating the operation of a common control unit.

FIG. 9 is a conceptual diagram illustrating a calculation method to be executed by the common control unit 14 (FIG. 2) by using the tone color parameter TC1 described above.

The constants CONST1 to CONSTk are directly supplied to k calculation combiners 81. The parameters LFOPAR1 to LFOPARk are supplied to k low frequency oscillators 82. The k low frequency oscillators 82 generate low frequency signals and supply them to the k calculation combiners 81. The parameters EGPAR1 to EGPARk are supplied to k envelope generators 83. The k envelope generators 83 generate envelopes and supply them to the k calculation combiners 81.

The combining operators COMB1 to COMBk are supplied to the k calculation combiners 81. The k calculation combiners 81 execute calculations by using the constants CONST1 to CONSTk, low frequency signals, envelopes, and musical tone signals WAVEx output from predetermined channels, in accordance with corresponding combining operators COMB1 to COMBk, and supply the calculation results to a common control parameter generator 86.

The pitch parameters PITCH1 to PITCHj are supplied to j phase generators 84 and a physical model pitch control information generator 85. The phase generator 84 generates phase data and the physical model pitch control information generator 85 generates the physical model pitch information 41*b* (FIG. 5), the phase data and physical model pitch information being supplied to the common control parameter generator 86. The phase data also contains the key code in a performance event.

The common control parameter generator 86 is also supplied with performance data (performance event) PLAYINFO and the musical tone signals WAVEy output from predetermined channels. The performance data PLAYINFO contains touch information, pitchbend information and the like.

The common control parameter generator 86 generates common control parameters and stores them in the buffer CPARBUF (FIG. 7B), The parameters PCMPAR, FMPAR, and/or PHSMDLPAR are supplied to a tone generator dependent control parameter generator 87. The tone generator dependent control parameter generator 87 is also supplied with the performance data PLAYINFO, musical tone signals WAVEz output from predetermined channels, and tone generator types TG_TYPE.

The tone generator dependent control parameter generator 87 generates tone generator dependent control parameters in accordance with the tone generator type TG-TYPE and stores them in the buffer TYPPARBUF (FIG. 7B).

The parameter buffer PARBUF of each channel has the common parameter buffer CPARBUF and tone generator dependent parameter buffer TYPPARBUF. The musical tone waveform generator unit 15 (FIG. 2) for each tone generator type is supplied with the parameter buffer PARBUF, tone generator type TG_TYPE, and performance data PLAYINFO including key-on/off.

Figure 10:
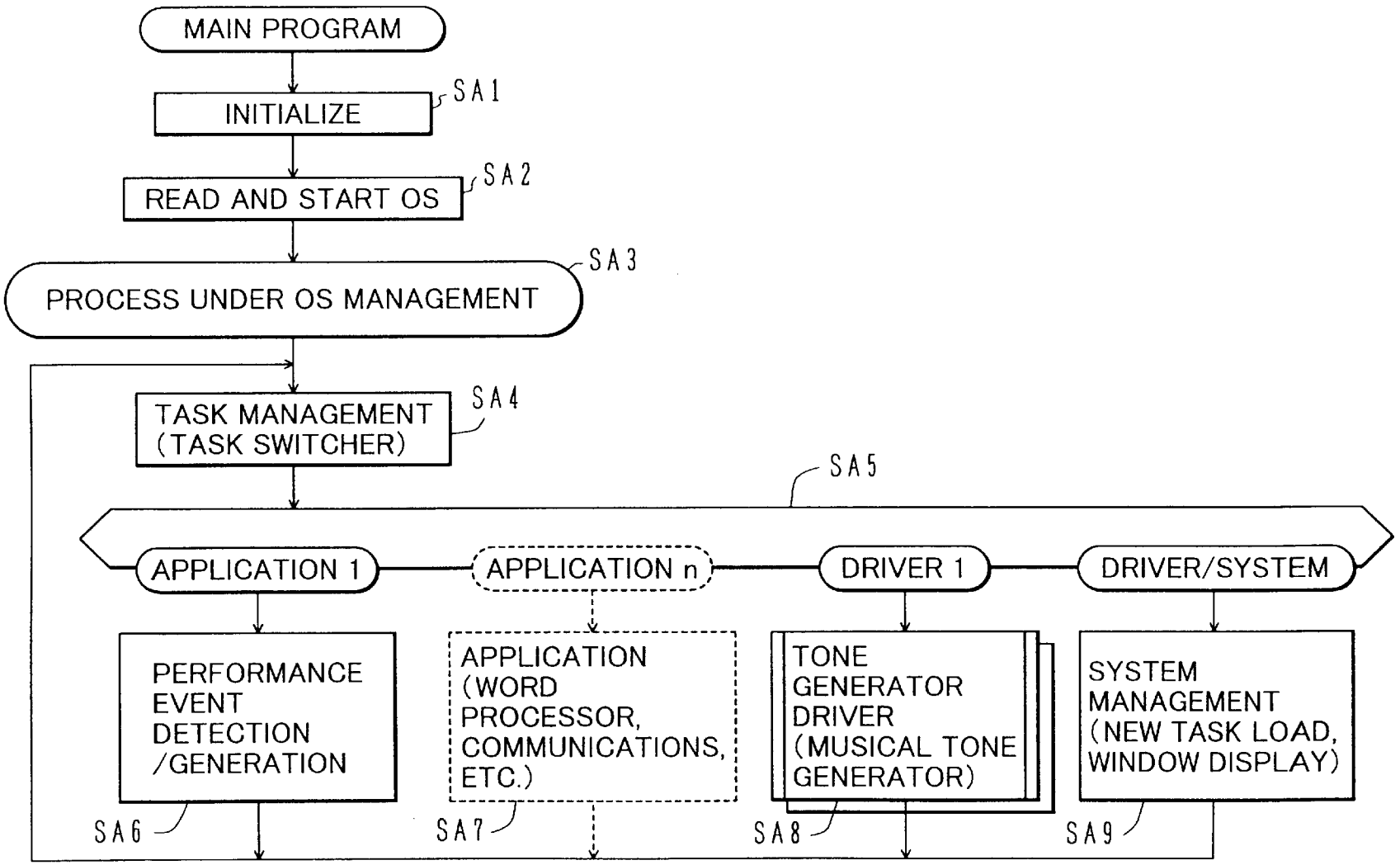
FIG. 10 is a flow chart illustrating a main routine to be executed by a CPU.

FIG. 10 is a flow chart illustrating a main routine to be executed by CPU.

At Step SA1, an initializing process is executed for the memory device, network interface and the like.

At Step SA2, the operating system (OS) is loaded from the memory device into RAM to activate OS.

At Step SA3, various processes under the OS management are performed, such as allocation of memory areas.

At Step SA4, task management (task switcher) is performed. With this task management, a plurality of tasks are enabled to be executed in parallel, and each task is given a particular priority order.

At Step SA5, the type of a task instructed to be activated is judged. For example, the types of tasks include an application 1, an application n, a driver 1, and a driver/system.

If the application 1 is instructed to be activated, a performance event is detected and generated at Step SA6, and thereafter the flow returns to Step SA4. For example, when a player manipulates a performance operator, a performance event is detected and generated.

If the application n is instructed to be activated, an application such as a word processor and communications is executed as Step SA7, and thereafter the flow returns to Step SA4.

If the driver 1 is instructed to be activated, the tone generator driver (musical tone generation) is processed at Step SA8, and thereafter the flow returns to Step SA4. The details of processing the tone generator driver will be later given with reference to the flow charts shown in FIGS. 11 to 14.

If the driver/system is instructed to be activated, the system management is processed at Step SA9, and thereafter the flow returns to Step SA4. For example, the system management includes loading a new task and displaying a window.

In processing the tone generator driver at Step SA8, the tone generator driver may be activated at an interval of one sample period to generate a waveform in units of sample, or a waveform may be generated continuously during an idle period of CPU and stored in a buffer.

Figure 11:
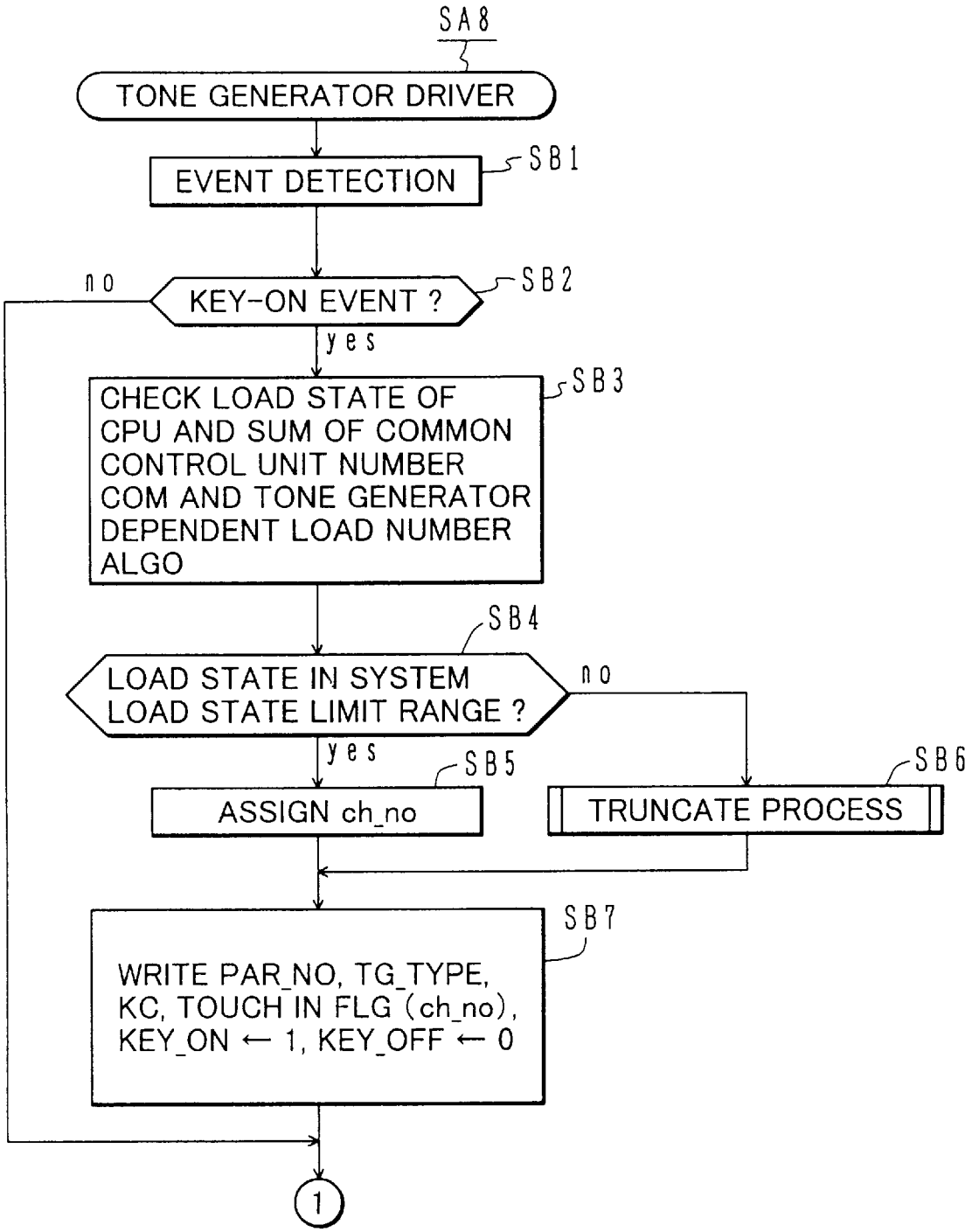
FIGS. 11 to 13 are flow charts illustrating the detailed operations of a tone generator driver to be executed at Step SA8 in FIG. 10.
Figure 12:
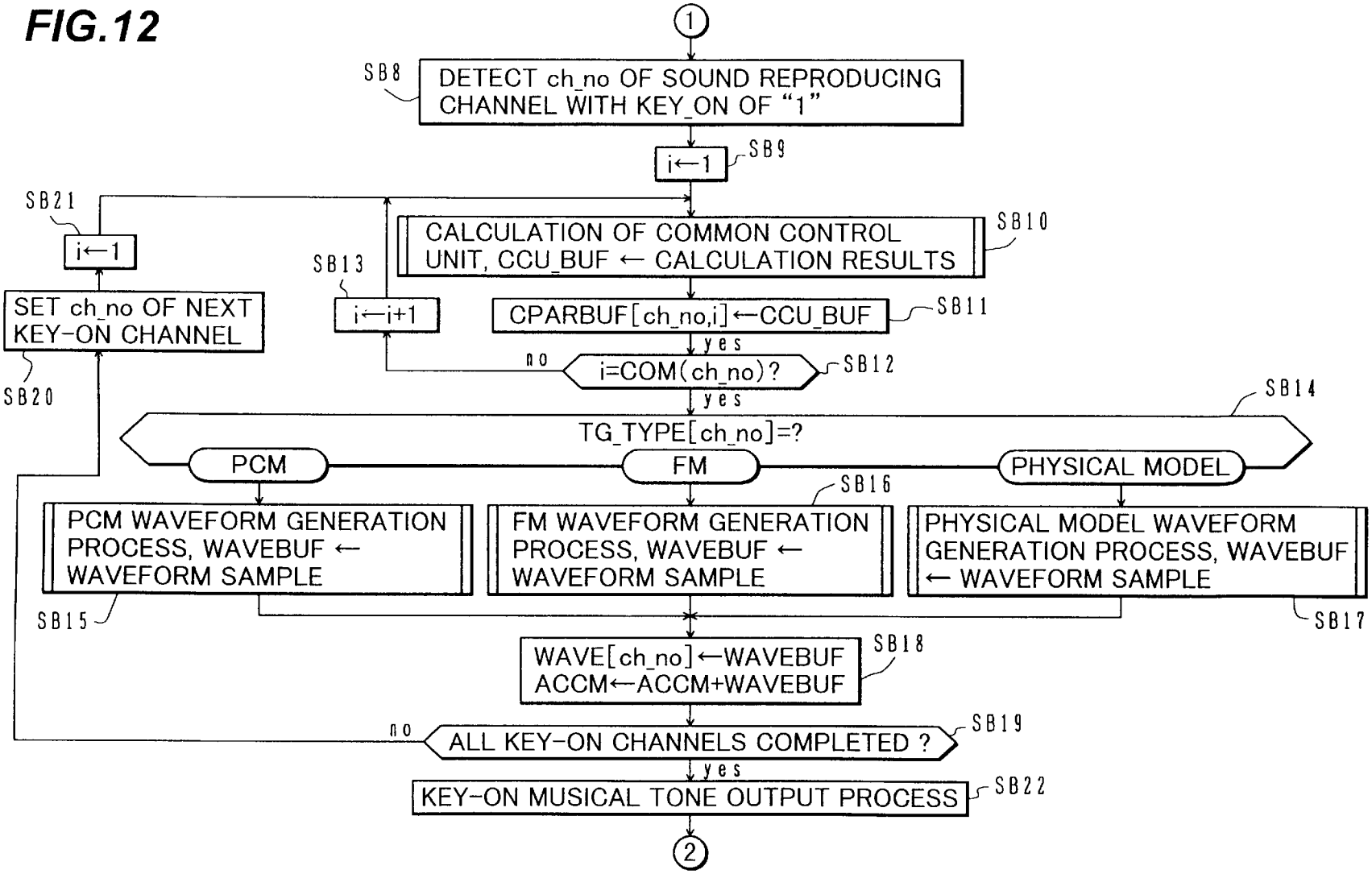
Figure 13:
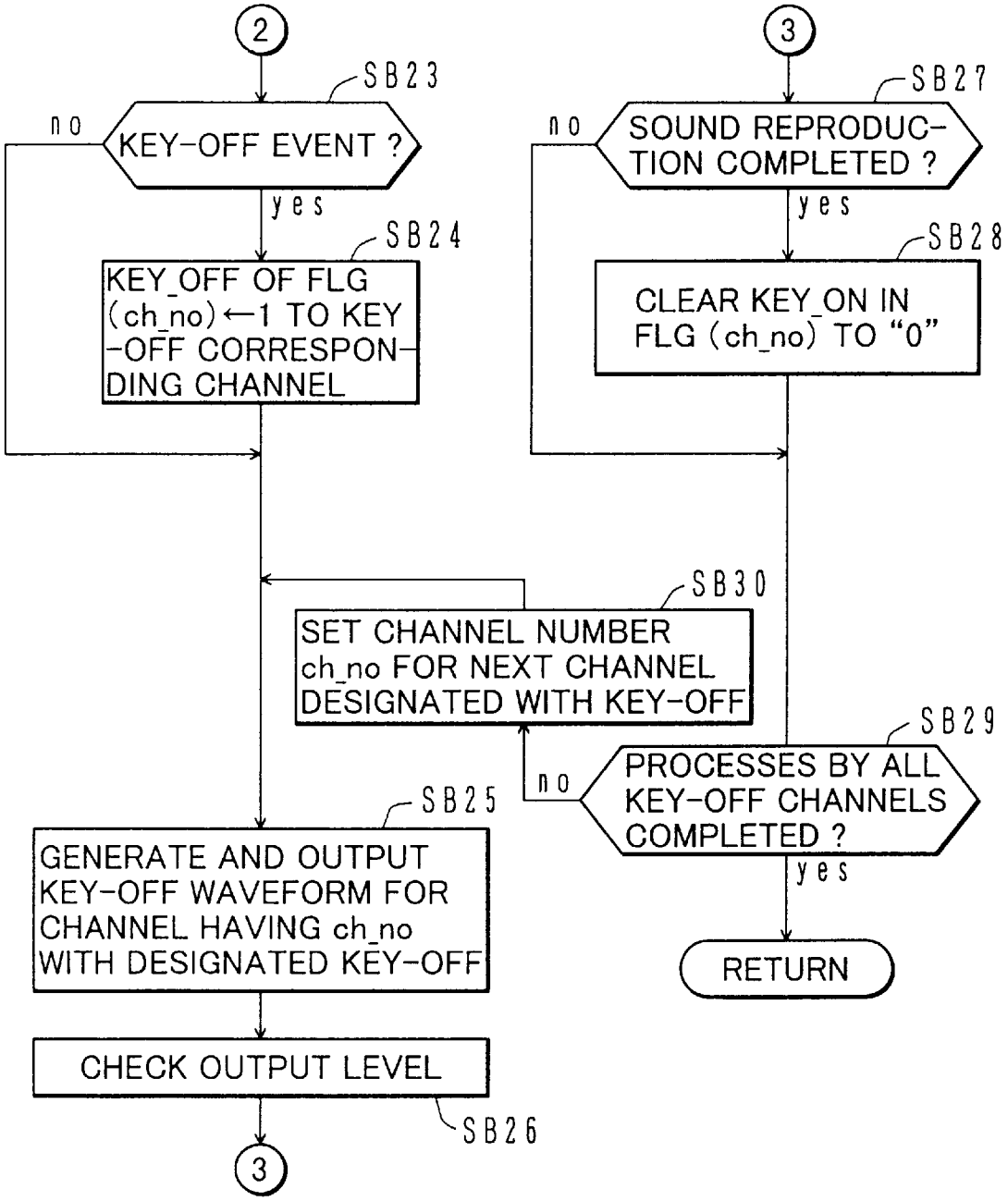

FIGS. 11 to 13 are flow charts illustrating the details of the operation to be executed by the tone generator drive at Step SA8 shown in FIG. 10.

An event detection process is performed at Step SB1. For example, an event includes a key-on event and a key-off event, and is generated through manipulation of the performance operator. For example, as a key of a keyboard is depressed, a key-on event is generated, and as the key is released, a key-off event is generated.

At Step SB2 it is checked whether the detected event is a key-on event. If the detected event is a key-on event, the flow advances to Step SB3, whereas if not, the key-on event process is not performed but the flow advances to Step SB8 shown in FIG. 12.

Step SB3 compares the load state of CPU with a sum of the common control unit number COM (FIG. 8) and tone generator dependent load number ALGO (FIG. 8) respectively of the channels under sound reproduction.

At Step SB4 it is checked whether the load state is in a system load limit range. If in the system load limit range, the key-on process is possible and the flow advances along a YES arrow to Step SB5 whereat a channel number ch-no is assigned to thereafter advance to Step SB7. If the load state is over the system load limit range, the key-on process is not possible and the flow advances along a NO arrow to Step SB6 whereat a truncate process is performed to reserve a channel and advance to Step SB7. The details of the truncate process will be later described with reference to the flow chart of FIG. 14.

At Step SB7, the tone color number PAR_NO tone generator type TG_TYPE, key code KC, and touch information TOUCH are written in the register FLG (ch-no) shown in FIG. 7B, and the flag KEY_ON is set to "1" and the flag KEY_OFF is set to "0" to indicate the key-on event. Thereafter, the flow advances to Step SB8 shown in FIG. 12.

At Step SB8 shown in FIG. 12, the channel number ch_no of a sound reproduction channel having the flag KEY_ON of "1" is detected. Since the tone generator driver is processed in unit of sample, the flag KEY_ON maintains "1" not only at the start of sound reproduction but also during sound production. The number of channels with the flag KEY_ON of "1" is "0" or "1" or more. If there are a plurality of channels, the order of channels to be processed is determined and the following loop is repeated as many times as the number of channels.

At Step SB9, "1" is set to a register i. The register i stores the number of the common control unit to be operated. The number i of the common control unit is sequentially given starting from "1", the last number i being the total of common control units to be operated.

At Step SB10, the common control unit performs calculations. This process corresponds to the operations described with FIG. 9, and generates common control parameters which are temporarily buffered in the buffer CCU_BUF before they are loaded in the buffer CPARBUF.

At Step SB11 the contents of the buffer CCU_BUF are copied to the buffer CPARBUF [ch_no, i]. The buffer CPARBUF [ch_no, i] stores common control parameters of the common control unit having the channel number i.

At Step SB12 it is checked whether the value of the register i is the same as the value of the register COM (ch_no). In other words, it is checked whether the processes by all the common control units have been completed. The register COM (ch_no) is the same as that shown in FIG. 8 and stores the common control unit number for the channel number ch_no.

If not completed, the flow advances along a NO arrow to Step SB13 whereat the register i is incremented to return to Step SB10 and operate the next common control unit. The operation of the common control unit is repeated for a predetermined number of times in accordance with the designated tone generator type. If the processes by all the common control units are completed, the flow advances along a YES arrow to Step SB14.

At Step SB14 it is checked whether the tone generator type TG_TYPE [ch_no] for the channel number ch_no indicates which one of the PCM tone generator, FM tone generator, and physical model tone generator.

If it indicates the PCM tone generator, a waveform of a PCM tone generator type is generated at Step SB15 and stored in the buffer WAVEBUF in unit of sample to thereafter follow Step SB18. This PCM tone generator process corresponds to the operations described with FIG. 3.

If it indicates the FM tone generator, a waveform of an FM tone generator type is generated at Step SB16 and stored in the buffer WAVEBUF in unit of sample to thereafter follow Step SB18. This FM tone generator process corresponds to the operations described with FIG. 4. In the example shown in FIG. 4, two common control units are used. In this case, the waveform generation process may be performed by two loop processes, or may be performed by one collective process.

If it indicates the physical model tone generator, a waveform of a physical model tone generator type is generated at Step SB17 and stored in the buffer WAVEBUF in unit of sample to thereafter follow Step SB18. This physical model tone generator process corresponds to the operations described with FIG. 5.

At Step SB18 the contents of the buffer WAVEBUF are copied to the buffer WAVE [ch_no] for the channel number ch_no and added to the register ACCM which stores an accumulation of waveforms of all the channels.

At Step SB19 it is checked whether the processes by all the key-on channels have been completed. If not, the flow advances along a NO arrow to Step SB20 whereat the channel number ch_no of the next key-on channel is set to thereafter advance to Step SB21. At Step SB21, "1" is set to the register i and the flow returns to Step SB10 whereat the next channel is processes. When the processes by all the key-on channels are completed, the flow advances along a YES arrow to Step SB22.

At Step SB22 a musical tone signal corresponding to the waveform value in the register ACCM is output. The musical tone signal is supplied to the D/A converter and reproduced from the sound system. Thereafter, the flow advances to Step SB23 shown in FIG. 13.

At Step SB23 shown in FIG. 13, it is checked whether any key-off event occurs. If there is a key-off event, the flow advances along a YES arrow to Step SB24 whereat the flag KEY_OFF of the register FLG (ch_no) for the channel number ch_no is set to "1" in order to key-off the subject channel, and thereafter the flow advances to Step SB25. If there is no key-off event, the flow advances along a NO arrow directly to Step SB25.

At Step SB25, a key-off waveform for the channel number ch_no with the flag KEY_OFF of "1" is generated and output to the D/A converter. This key-off process is generally the same as the key-on process at Steps SB8 to SB22 described above.

At Step SB26, an output level is checked and the flow advances upper right in FIG. 13 to Step SB27 whereat it is checked whether the sound reproduction has been completed. If the output level is sufficiently small, it can be judged that the sound reproduction has been completed. If completed, the flow advances along a YES arrow to Step SB28 whereat the flag KEY_ON of the register FLG (ch_no) is set to "0" to follow Step SB29. If the sound reproduction is not completed, the flow advances along a NO arrow directly to Step SB29.

At Step SB29 it is checked whether the processes by all the key-off channels have been completed. If not, the flow advances along a NO arrow to Step SB30 whereat the channel number ch_no with the next designated key-off is set to thereafter return to Sep SB25 and process the next channel. If the processes by all the key-off channels have been completed, the flow advances along the YES arrow to terminate the tone generator driver process.

Figure 14:
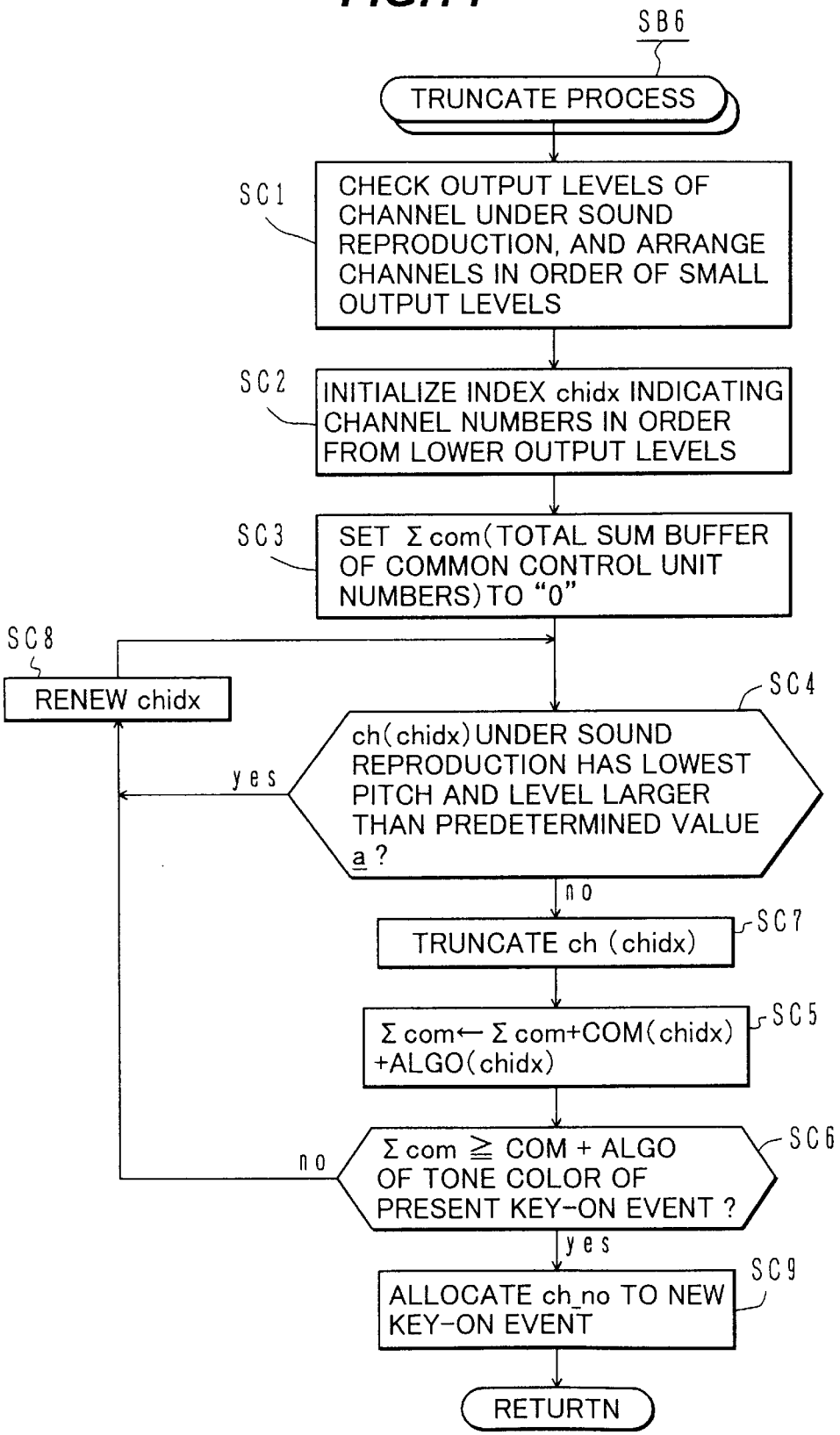
FIG. 14 is a flow chart illustrating the detailed operations of a truncate process at Step SB6 in FIG. 11.

FIG. 14 is a flow chart illustrating the details of the truncate process at Step SB6 shown in FIG. 11.

At Step SC1, an output level of a channel under sound reproduction is checked, and the output levels of channels are arranged in the order of smaller output levels.

At Step SC2, an index chidx is initialized. The index chidx shows the channel number in the order from lower output level to higher output level. The channels are truncated in the order of lower output level.

At Step SC3, a register Σcom is set to "0". The register Σcom stores a total sum of common control unit numbers of respective channels.

At Step SC4 it is checked whether the channel ch(chidx) under sound reproduction has a pitch KC lowest among all channels under sound reproduction and also has an output level larger than a predetermined value a. If these conditions are not satisfied, the flow advances along a NO arrow to Step SC7 whereat the channel ch (chidx) is truncated to thereafter follow Step SC5. If the conditions are satisfied, the flow advances along a YES arrow to Step SC8 without performing the truncate process. Since a sound having the lowest pitch is a root sound in many cases, the sound having an output level larger than the predetermined level a is not truncated.

At Step SC5, the values of the register COM (chidx) and register ALGO (chidx) are added to the register Σcom. The register COM (chidx) stores the common control unit number for the channel number chidx, and the register ALGO (chidx) stores the tone generator dependent load number for the channel number chidx.

At Step SC6 it is checked whether the number in the register Σcom is larger than the value of COM+ALGO of the tone color of the present key-on event. Namely, it is checked whether channels sufficient for sound reproduction of the new key-on event can be reserved.

If still not reserved, the flow advances along a NO arrow to Step SC8 whereat the index chidx is renewed and the flow returns to Step SC4 to process the next lower output level channel to truncate it.

If sufficient channels are reserved, the flow advances along a YES arrow to Step SC9 whereat the empty channel number ch_no is allocated to the new key-event to terminate the truncate process.

The truncate process is performed in the order of lower output level in the manner described above. During this truncate process, a load condition is calculated from the values of the registers COM and ALGO, and channels are truncated as many as sufficient for sound reproduction of the new key-on event. The truncate process is performed in accordance with a sound reproduction state and the load state of CPU. Since the load state of CPU changes with the tone generator type, the number of channels to be truncated changes with the tone generator type (tone color) of the new key-on event.

The truncate process at Step SC7 truncates a channel each time the truncate candidate is determined. After all truncate candidates are determined, the candidates may be truncated at the same time.

During the truncate process, if a volume is lowered abruptly, click noises are generated. In order to prevent click noises, it is therefore necessary to generate an empty channel after the volume is lowered. For the general background of truncate process, for example, refer to JP-B-SHOU 62-47316 which is herein incorporated by reference. In FIGS. 1, 2, 3, 5, 8 and other drawings of this gazette, techniques are disclosed in which a damp signal (rapid attenuation command) is applied to a channel selected as the truncate candidate, and after the attenuation completion, a new key-on event is assigned to the empty channel.

In the multi tone generator of this embodiment sound, a common control unit shares a processing unit common to a plurality of tone generators. Therefore, a tone generator or tone generator driver which is efficient and cost effective can be realized.

Although the maximum number of channels is fixed for a hardware tone generator, it can be dynamically changed for a software tone generator. An upper limit of the maximum channel number depends on a CPU performance or a memory capacity.

The present invention has been described in connection with the preferred embodiments. The invention is not limited only to the above embodiments. It is apparent that various modifications, improvements, combinations, and the like can be made by those skilled in the art.

What is claimed is:

1. A musical tone signal generating method for a multi tone generator, comprising steps of:

(a) instructing a start of generating a musical tone signal;

(b) designating a tone generator type for generating the musical tone signal, from a plurality of tone generator types;

(c) performing a first stage of tone synthesis processing by executing a tone synthesis process, wherein said first stage tone synthesis process is shared in common by the plurality of tone generator types and wherein said first stage tone synthesis process has an output, said first stage of tone synthesis processing being performed when the start of generating the musical tone signal is instructed; and (d) performing a second stage of tone synthesis processing specific to the designated tone generator type, wherein at least part of said second stage of tone synthesis processing uses the output of said first stage of tone synthesis processing.

2. A musical tone signal generating method for a multi tone generator according to claim 1, further comprising the step of:

(e) after said step (a), assigning a sound reproduction channel if it is judged from a load necessary for said step (c) or (d) that the sound reproduction channel can be assigned, or performing a truncate process if it is judged that the sound reproduction channel cannot be assigned.

3. A musical tone signal generating method for a multi tone generator according to claim 2, wherein said step (e) performs the truncate process as much as sufficient for the number of channels suitable for the load necessary for said step (c) or (d).

4. A musical tone signal generating method for a multi tone generator according to claim 1, wherein the plurality of tone generator types contain at least one type of a PCM tone generator, an FM tone generator, a physical model tone generator, and a formant tone generator.

5. A musical tone signal generating method for a multi tone generator according to claim 1, wherein the common process is a phase generation process, an envelope generation process, a low frequency oscillation process, or a filtering process.

6. A musical tone signal generating method for a multi tone generator according to claim 1, wherein said step (b) designates the tone generator type in accordance with a tone color of a musical signal designated to start being generated.

7. A musical tone signal generating method for a multi tone generator according to claim 1, wherein said step (c) performs the common process in accordance with a fed-back signal of the musical tone signal generated at said step (d).

8. A musical tone signal generating method for a multi tone generator according to claim 4, wherein the plurality of tone generator types includes at least a PCM tone generator type, and when the PCM tone generator type is designated at said step (b), said step (c) performs a phase generation process and said step (d) reads waveform data from a waveform memory in accordance with a phase generated by the phase generation process to generate the musical tone signal.

9. A musical tone signal generating method for a multi tone generator according to claim 4, wherein the plurality of tone generator types includes at least an FM tone generator type, and when the FM tone generator type is designated at said step (b), said step (c) performs a phase generation process and said step (d) generates a sine wave in accordance with a phase generated by the phase generation process to generate the musical tone signal.

10. A musical tone signal generating method for a multi tone generator according to claim 6, wherein the plurality of tone generator types includes at least a physical model tone generator type, and said step (b) designates a physical model tone generator type if a tone color of a stringed instrument or a wind instrument is used.

11. A musical tone signal generating method for a multi tone generator according to claim 1, wherein said step (b) designates the tone generator type in accordance with a load of a current musical tone signal generating process.

12. A musical tone signal generating method for a multi tone generator according to claim 1, wherein said step (c) repeats the first stage of tone synthesis processing for a predetermined number of times for each of one or more waveforms to be generated in accordance with the designated tone generator type.

13. A musical tone signal generating method for a multi tone generator according to claim 1, wherein said step (c) further comprises the step of receiving an input signal in accordance with the designated tone generator type.

14. A musical tone signal generating method for a multi tone generator according to claim 1, further comprising the steps of:

(e) after said step (c), storing in a buffer the output generated in said step (c);

(f) after said step (e), supplying the output in the buffer, the designated tone generator type, and performance data to one or more type of tone generator.

15. A medium storing a program to be executed by a computer, the program comprising the steps of:

(a) instructing a start of generating a musical tone signal;

(b) designating a tone generator type for generating the musical tone signal, from a plurality of tone generator types;

(c) performing a first stage of tone synthesis processing by executing a tone synthesis process, wherein said first stage tone synthesis process is shared in common by the plurality of tone generator types and wherein said first stage tone synthesis process has an output, said first stage of tone synthesis processing being performed when the start of generating the musical tone signal is instructed; and (d) performing a second stage of tone synthesis processing specific to the designated tone generator type, wherein at least part of said second stage of tone synthesis processing uses the output of said first stage of tone synthesis processing.

16. A medium storing a program to be executed by a computer according to claim 15, the program further comprising the step of:

(e) after said step (a), assigning a sound reproduction channel if it is judged from a load necessary for said step (c) or (d) that the sound reproduction channel can be assigned, or performing a truncate process if it is judged that the sound reproduction channel cannot be assigned.

17. A medium storing a program to be executed by a computer according to claim 16, wherein said step (e) performs the truncate process as much as sufficient for the number of channels suitable for the load necessary for said step (c) or (d).

18. A medium storing a program to be executed by a computer according to claim 15, wherein the plurality of tone generator types contain at least one type of a PCM tone generator, an FM tone generator, a physical model tone generator, and a formant tone generator.

19. A medium storing a program to be executed by a computer according to claim 15, wherein the common process is a phase generation process, an envelope generation process, a low frequency oscillation process, or a filtering process.

20. A medium storing a program to be executed by a computer according to claim 15, wherein said step (b) designates the tone generator type in accordance with a tone color of a musical signal designated to start being generated.

21. A medium storing a program to be executed by a computer according to claim 13, wherein said step (c) performs the common process in accordance with a fed-back signal of the musical tone signal generated at said step (d).

22. A medium storing a program to be executed by a computer according to claim 18, wherein the plurality of tone generator types includes at least a PCM tone generator type, and when the PCM tone generator type is designated at said step (b), said step (c) performs a phase generation process and said step (d) reads waveform data from a waveform memory in accordance with a phase generated by the phase generation process to generate the musical tone signal.

23. A medium storing a program to be executed by a computer according to claim 18, wherein the plurality of tone generator types includes at least an FM tone generator type, and when the FM tone generator type is designated at said step (b), said step (c) performs a phase generation process and said step (d) generates a sine wave in accordance with a phase generated by the phase generation process to generate the musical tone signal.

24. A medium storing a program to be executed by a computer according to claim 20, wherein the plurality of tone generator types includes at least a physical model tone generator type, and said step (b) designates a physical model tone generator type if a tone color of a stringed instrument or a wind instrument is used.

25. A medium storing a program to be executed by a computer according to claim 15, wherein said step (b) designates the tone generator type in accordance with a load of a current musical tone signal generating process.

26. A medium storing a program to be executed by a computer according to claim 15, wherein said step (c) repeats the first stage of tone synthesis processing for a predetermined number of times for each of one or more waveforms to be generated in accordance with the designated tone generator type.

27. A medium storing a program to be executed by a computer according to claim 15, wherein said step (c) further comprises the step of receiving an input signal in accordance with the designated tone generator type.

28. A medium storing a program to be executed by a computer according to claim 15, wherein the program further comprises the steps of:

(e) after said step (c), storing in a buffer the output generated in said step (c);

(f) after said step (e), supplying the output in the buffer, the designated tone generator type, and performance data to one or more type of tone generator.

29. A multi tone generator comprising:

means for instructing a start of generating a musical tone signal;

means for designating a tone generator type for generating the musical tone signal, from a plurality of tone generator types;

means for performing a first stage of tone synthesis processing by executing a tone synthesis process, wherein said first stage tone synthesis process is shared in common by the plurality of tone generator types and wherein said first stage tone synthesis process has an output, said first stage of tone synthesis processing being performed when the start of generating the musical tone signal is instructed; and means for performing a second stage of tone synthesis processing specific to the designated tone generator type, wherein at least part of said second stage of tone synthesis processing uses the output of said first stage of tone synthesis processing.

30. A multi tone generator according to claim 29, further comprising:

means, responsive to the instruction of the start of generating the musical tone signal, for assigning a sound reproduction channel if it is judged from a load necessary for said common process performing means or said musical tone signal generating means that the sound reproduction channel can be assigned, or performing a truncate process if it is judged that the sound reproduction channel cannot be assigned.

31. A multi tone generator according to claim 30, wherein the truncate process is performed as much as sufficient for the number of channels suitable for the load necessary for said common process performing means or said musical tone signal generating means.

32. A multi tone generator according to claim 29, wherein the plurality of tone generator types contain at least one type of a PCM tone generator, an FM tone generator, a physical model tone generator, and a formant tone generator.

33. A multi tone generator according to claim 29, wherein the common process is a phase generation process, an envelope generation process, a low frequency oscillation process, or a filtering process.

34. A multi tone generator according to claim 29, wherein said designating means designates the tone generator type in accordance with a tone color of a musical signal designated to start being generated.

35. A multi tone generator according to claim 29, wherein said common process performing means performs the common process in accordance with a fed-back signal of the musical tone signal generated at said musical tone signal generating means.

36. A multi tone generator according to claim 32, wherein the plurality of tone generator types includes at least a PCM tone generator type, and when the PCM tone generator type is designated at said designating means, said common process performing means performs a phase generation process and said musical tone signal generating means reads waveform data from a waveform memory in accordance with a phase generated by the phase generation process to generate the musical tone signal.

37. A multi tone generator according to claim 32, wherein the plurality of tone generator types includes at least an FM tone generator type, and when the FM tone generator type is designated at said step designating means, said common process performing means performs a phase generation process and said step musical tone signal generating means generates a sine wave in accordance with a phase generated by the phase generation process to generate the musical tone signal.

38. A multi tone generator according to claim 34, wherein the plurality of tone generator types includes at least a physical model tone generator type, and said designating means designates a physical model tone generator type if a tone color of a stringed instrument or a wind instrument is used.

39. A multi tone generator according to claim 29, wherein said designating means designates the tone generator type in accordance with a load of a current musical tone signal generating process.

40. A multi tone generator according to claim 29, wherein said first stage of tone synthesis processing is repeated for a predetermined number of times for each of one or more waveforms to be generated in accordance with the designated tone generator type.

41. A multi tone generator according to claim 29, wherein said first stage tone synthesis process comprises the step of receiving an input signal in accordance with the designated tone generator type.

42. A multi tone generator according to claim 29, further comprising:

means for storing in a buffer the output generated by said means for performing a first stage of tone synthesis processing; and means for supplying the output in the buffer, the designated tone generator type, and performance data to one or more type of tone generator.

43. A multi tone generator comprising:

an instructor for instructing a start of generating a musical tone signal;

a designator for designating a tone generator for generating the musical tone signal, from a plurality of tone generator types;

a common process performing for performing a first stage of tone synthesis processing by executing a tone synthesis process, wherein said first stage tone synthesis process is shared in common by the plurality of tone generator types and wherein said first stage tone synthesis process has an output, said first stage of tone synthesis processing being performed when the start of generating the musical tone signal is instructed; and a performer for performing a second stage of tone synthesis processing specific to the designated tone generator type, wherein at least part of said second stage of tone synthesis processing uses the output of said first stage of tone synthesis processing.

44. A multi tone generator comprising:

a performance operator;

a first memory storing tone generator drivers;

a second memory coupled to said first memory, wherein said second memory is adapted to receive copies of said tone generator drivers from said first memory;

a CPU coupled to said performance operator and said second memory, wherein said CPU is adapted to receive a start instruction from said performance operator, wherein said CPU is adapted to perform a first stage of tone synthesis processing by executing a tone synthesis process, wherein said first stage tone synthesis process is shared in common by a plurality of tone generator types and wherein said first stage tone synthesis process has an output, said first stage of tone synthesis processing being performed when said start instruction is received by said CPU, wherein said CPU is adapted to designate a type of tone generator for generating a musical tone signal, and wherein said CPU is adapted to perform a second stage of tone synthesis processing specific to said designated tone generator type, wherein at least part of said second stage of tone synthesis processing uses the output of said first stage of tone synthesis processing.

* * * * *